US010096936B2

(12) United States Patent
Ju

(10) Patent No.: US 10,096,936 B2
(45) Date of Patent: Oct. 9, 2018

(54) CABLE CONNECTOR ASSEMBLY

(71) Applicant: LOTES CO., LTD, Keelung (TW)

(72) Inventor: Ted Ju, Keelung (TW)

(73) Assignee: LOTES CO., LTD, Keelung (TW)

( * ) Notice: Subject to any disclaimer, the term of this patent is extended or adjusted under 35 U.S.C. 154(b) by 0 days.

(21) Appl. No.: 15/828,862

(22) Filed: Dec. 1, 2017

(65) Prior Publication Data

US 2018/0166825 A1 Jun. 14, 2018

(30) Foreign Application Priority Data

Dec. 8, 2016 (CN) ..... 2016 2 1337685 U

(51) Int. Cl.

| | |
|---|---|
| ***H01R 13/6585*** | (2011.01) |
| ***H01R 13/627*** | (2006.01) |
| ***H01R 13/6581*** | (2011.01) |
| ***H01R 13/405*** | (2006.01) |
| ***H01R 24/22*** | (2011.01) |
| ***H01R 13/6593*** | (2011.01) |
| *H01R 107/00* | (2006.01) |
| *H01R 4/02* | (2006.01) |
| *H01R 24/60* | (2011.01) |

(52) U.S. Cl.

CPC ..... *H01R 13/6273* (2013.01); *H01R 13/405* (2013.01); *H01R 13/6275* (2013.01); *H01R 13/6581* (2013.01); *H01R 13/6593* (2013.01); *H01R 24/22* (2013.01); *H01R 4/023* (2013.01); *H01R 24/60* (2013.01); *H01R 2107/00* (2013.01)

(58) Field of Classification Search

CPC ..... H01R 13/6581; H01R 13/6583
USPC ..... 439/607.08, 607.11, 607.48
See application file for complete search history.

(56) References Cited

U.S. PATENT DOCUMENTS

| | | | | |
|---|---|---|---|---|
| 5,797,771 A * | 8/1998 | Garside | H01R 13/6275 | 439/358 |
| 8,142,224 B2 * | 3/2012 | Wu | H01R 13/648 | 439/353 |
| 8,262,411 B2 * | 9/2012 | Kondo | H01R 13/6658 | 439/607.01 |

(Continued)

FOREIGN PATENT DOCUMENTS

| | | |
|---|---|---|
| CN | 204992025 U | 1/2016 |
| CN | 205264920 U | 5/2016 |

(Continued)

*Primary Examiner* — Neil Abrams
(74) *Attorney, Agent, or Firm* — Locke Lord LLP; Tim Tingkang Xia, Esq.

(57) ABSTRACT

A cable connector assembly includes an electric connector having an insulating body, a first terminal group, a second terminal group, a latch member, and a first metal shell; and a second metal shell partially wrapping the periphery of a first metal shell. The first and second terminal groups have first and second ground terminals. The latch member is arranged in the insulating body and located between the first and second terminal groups. The latch member has a backward elastic arm partially protruding out of the insulating body. Both the first and second ground terminals are in electric contact with the latch member. The second metal shell has a cable-clamping portion for fixing a cable. The elastic arm elastically urges against the second metal shell.

20 Claims, 10 Drawing Sheets

(56) References Cited

U.S. PATENT DOCUMENTS 8,851,927 B2 * 10/2014 Hsu ..... H01R 12/724 439/607.11
8,961,230 B2 * 2/2015 Chou ..... H01R 9/032 439/607.27
8,968,031 B2 * 3/2015 Simmel ..... H01R 13/659 439/660
9,214,766 B1 * 12/2015 Yu ..... H01R 13/6585
9,231,356 B1 * 1/2016 Ju ..... H01R 24/78
9,281,629 B2 * 3/2016 Little ..... H01R 13/6583
9,306,336 B2 * 4/2016 Chang ..... H01R 13/6471
9,312,641 B2 * 4/2016 Wang ..... H01R 13/6585
9,350,121 B2 * 5/2016 Ju ..... H01R 13/6585
9,450,337 B2 * 9/2016 Kao ..... H01R 13/6461
9,502,841 B2 * 11/2016 Little ..... H01R 4/023
9,515,439 B2 * 12/2016 Ng ..... H01R 24/70
9,627,817 B2 * 4/2017 Chang ..... H01R 13/6594
9,673,569 B2 * 6/2017 Zhang ..... H01R 13/6585
9,680,254 B1 * 6/2017 Nishikata ..... H01R 13/627
9,722,369 B1 * 8/2017 Hsu ..... H01R 24/60
9,728,885 B2 * 8/2017 Yokoyama ..... H01R 13/42
9,728,899 B2 * 8/2017 Peng ..... H01R 13/6581
9,742,098 B2 * 8/2017 Zhao ..... H01R 13/5202
9,780,479 B2 * 10/2017 Guo ..... H01R 13/504
9,780,497 B1 * 10/2017 Jeon ..... H01R 13/659
9,787,008 B2 * 10/2017 Gou ..... H01R 12/53
9,812,816 B2 * 11/2017 Imai ..... H01R 13/6581
9,837,769 B2 * 12/2017 Yu ..... H01R 12/716
9,843,148 B2 * 12/2017 Little ..... H01R 24/60
9,853,399 B2 * 12/2017 Kao ..... H01R 13/6585
9,865,962 B2 * 1/2018 Zhao ..... H01R 13/5202
9,871,327 B2 * 1/2018 Simmel ..... H01R 13/659
9,917,405 B2 * 3/2018 Ju ..... H01R 13/6585
9,929,520 B2 * 3/2018 Zhao ..... H01R 13/5202
9,954,319 B2 * 4/2018 Zhao ..... H01R 13/6591
9,954,326 B2 * 4/2018 Gou ..... H01R 12/716
9,972,943 B2 * 5/2018 Jeon ..... H01R 13/6581
9,972,946 B2 * 5/2018 Ju ..... H01R 13/6585
9,991,640 B2 * 6/2018 Tziviskos ..... H01R 13/6581
9,997,869 B2 * 6/2018 Zhang ..... H01R 13/6585
10,008,793 B2 * 6/2018 Ju ..... H01R 24/78
10,008,811 B2 * 6/2018 Ho ..... H01R 13/6585
10,020,619 B2 * 7/2018 Zhang ..... H01R 12/7082
10,027,063 B2 * 7/2018 Peng ..... H01R 13/658
2010/0210124 A1 * 8/2010 Li ..... H01R 12/707 439/108
2016/0087378 A1 * 3/2016 Chen ..... H01R 13/6597 439/607.34
2016/0294121 A1 * 10/2016 Daughtry, Jr. ..... H01R 13/405
2017/0040750 A1 * 2/2017 Little ..... H01R 13/6597
2018/0166825 A1 * 6/2018 Ju ..... H01R 13/6273
2018/0183186 A1 * 6/2018 Yu ..... H01R 13/6581

FOREIGN PATENT DOCUMENTS

CN 105633729 A 6/2016
CN 205282693 U 6/2016
CN 205282695 U 6/2016
CN 205565062 U 9/2016
CN 106058530 A 10/2016
TW M527626 B 4/2003
TW 201616731 A 5/2016

* cited by examiner

A-A

C–C

CABLE CONNECTOR ASSEMBLY

CROSS-REFERENCE TO RELATED APPLICATIONS

This non-provisional application claims priority to and benefit of, under 35 U.S.C. § 119(a), Patent Application No. 201621337685.X filed in P.R. China on Dec. 8, 2016, the entire content of which is hereby incorporated by reference.

FIELD OF THE INVENTION

The invention relates to a cable connector assembly, and more particularly to a cable connector assembly that is used to be plugged in a receptacle connector.

BACKGROUND OF THE INVENTION

An existing cable connector assembly includes a plug connector that is configured to be plugged in a receptacle connector. The plug connector includes an insulating body, an upper terminal group and a lower terminal group fixed in the insulating body, a metal latch member received in the insulating body, and a metal shell sleeved on the insulating body. The latch member is provided with an urging portion projecting toward the metal shell and urges against the inner wall of the metal shell to achieve a grounding effect. However, limited by the size of the plug connector, the metal shell can hardly have enough space inside to accommodate the urging portion. As a result, the shape of the latch member is complex in shape, and actual production is difficult. Moreover, since the first metal shell does not have enough space inside to accommodate the urging portion, the urging portion almost has no elasticity. That is, the latch member is in rigid contact with the metal shell. As a result, when the latch member urges against the metal shell too tightly, it is easy for the latch member to deform or hard for the metal shell to be assembled onto the insulating body. When the latch member urges against the metal shell too loose, it is easy for the latch member to be in poor contact with the inner wall of the metal shell to affect the grounding effect of the electrical connector, thus affecting the high-frequency transmission of the cable connector assembly.

Therefore, a heretofore unaddressed need exists in the art to address the aforementioned deficiencies and inadequacies.

SUMMARY OF THE INVENTION

In one aspect, the present invention relates to a cable connector assembly that is easy to produce and has a good grounding effect.

In certain embodiments, a cable connector assembly is used to be plugged in a receptacle connector. The cable connector assembly includes an electrical connector, a cable, and a second metal shell. The electrical connector includes an insulating body, a first terminal group and a second terminal group respectively received in the insulating body and arranged in an upper row and a lower row, a latch member arranged in the insulating body and located between the first terminal group and the second terminal group, and a first metal shell wrapping the periphery of the insulating body. The first terminal group includes at least one first ground terminal, and the second terminal group includes at least one second ground terminal. The latch member has a pair of forward latch arms received in the insulating body. The latch arms are configured to latch the receptacle connector. The latch member has at least one backward elastic arm which partially protrudes out of the insulating body. Both the first ground terminal and the second ground terminal are in electrical contact with the latch member. The elastic arm protrudes backward out of the first metal shell. The cable is configured to be in electrical contact with the first terminal group and the second terminal group. The second metal shell partially wraps the periphery of the first metal shell. The second metal shell has a cable-clamping portion for fixing the cable. The elastic arm elastically urges against the second metal shell.

In certain embodiments, the latch member has two elastic arms. Each elastic arm is formed by deflecting outward from the rear end of each latch arm and extending backward, and the spacing between the two elastic arms is larger than the spacing between the two latch arms.

In certain embodiments, the first ground terminal and the second ground terminal are located respectively on the upper and lower sides of the elastic arms to be in electrical contact with the front sections of the elastic arms, the rear section of each elastic arm is provided with a conducting portion projected toward the sidewall of the second metal shell, and the conducting portion elastically urges against the second metal shell.

In certain embodiments, an elastic portion which extends integrally from the rear end of the first ground terminal or the second ground terminal protrudes out of the rear end of the insulating body, and the elastic portions are located at the front sides of the elastic arms to elastically urge against the second metal shell.

In certain embodiments, the first terminal group and an upper insulating block are insert-molded as a whole, the second terminal group and a lower insulating block are insert-molded as a whole, and the rear end of the insulating body is provided with a forward accommodating cavity. The upper insulating block and the lower insulating block are assembled into the accommodating cavity after being assembled together, and a placement platform is formed which protrudes out of the rear end of the accommodating cavity. The cable is arranged on the upper surface and lower surface of the placement platform in order to be soldered to the first terminal group and the second terminal group. The elastic arms protrude out of a rear end of the placement platform in order to elastically urge against the second metal shell.

In certain embodiments, the placement platform is provided with at least one open slot along a direction from the rear end of the placement platform to a front end of the placement platform. The first terminal group includes at least one first power terminal. The first power terminal has a first soldering surface exposed to the open slot. The second terminal group includes at least one second power terminal. The second power terminal has a second soldering surface exposed to the open slot. The cable has at least one power wire which is inserted into the open lot and located between the first soldering surface and the second soldering surface, and the power wire is soldered to the first soldering surface and the second soldering surface.

In certain embodiments, the front end of the second metal shell is provided with a first covering portion for wrapping and fixing the rear side of the first metal shell, the second metal shell is provided with a second covering portion for covering the cable, the cable-clamping portion is formed by extending backward from the rear end of the second covering portion, a ground sheet extending integrally from the second metal shell is located between the first covering portion and the second covering portion, and the ground sheet is in electrical contact with the first ground terminal or the second ground terminal.

In certain embodiments, the cable includes at least one ground wire, and the at least one ground wire is in electrical contact with at least one of the first ground terminal, the second ground terminal, the latch member and the second metal shell.

In certain embodiments, the sidewall of the second metal shell is provided with a soldering hole, and the ground wire is inserted in the soldering hole in order to be soldered to the second metal shell.

In certain embodiments, the second metal shell includes an upper shell and a lower shell. Both sides of the upper shell are provided with a plurality of fastening portions, and both sides of the lower shell are provided with a plurality of fastening holes correspondingly matching with the fastening portions. The soldering hole is located between two neighboring fastening portions.

In another aspect, the present invention relates to a cable connector assembly for being electrically connected with a receptacle connector. The cable connector assembly includes an electrical connector, a second metal shell, and a cable. The electrical connector includes an insulating body, a plurality of signal terminals received in the insulating body and being in electrical contact with the receptacle connector, a ground assembly retained in the insulating body and partially protruding out of the rear end of the insulating body, and a first metal shell wrapping the periphery of the insulating body. The second metal shell partially wraps the periphery of the first metal shell. The ground assembly elastically urges against the second metal shell. The second metal shell has a cable-clamping portion for fixing the cable. The cable has a plurality of signal wires and at least one ground wire. The signal wires are correspondingly in electrical contact with the signal terminals, and the ground wire is in electrical contact with the ground assembly or the second metal shell.

In certain embodiments, the ground assembly includes a first ground terminal and a latch member. The front end of the latch member is provided with a pair of latch arms for latching the receptacle connector. An elastic arm extends backward from each latch arm and protrudes out of the rear end of the insulating body. The elastic arms elastically urge against the second metal shell. The first ground terminal is in electrical contact with the latch member or the second metal shell.

In certain embodiments, the ground assembly includes a first ground terminal and a latch member. The latch member is in electrical contact with the first ground terminal. The rear end of the first ground terminal is provided with an elastic portion which protrudes out of the rear end of the insulating body. The elastic portion elastically urges against the second metal shell.

In certain embodiments, the ground assembly includes a first ground terminal, a second ground terminal, and a latch member located between the first ground terminal and the second ground terminal. The rear end of the first ground terminal is provided with a first elastic portion that protrudes out of the rear end of the insulating body. The rear end of the second ground terminal is provided with a second elastic portion that protrudes out of the rear end of the insulating body. The front end of the latch member is provided with a pair of latch arms for latching the receptacle connector. At least one elastic arm extends backward from the latch member and protrudes out of the rear end of the insulating body. The elastic arm elastically urges against the second metal shell. The first elastic portion and the second elastic portion are located at the front side of the elastic arm to elastically urge against the second metal shell.

In certain embodiments, the ground assembly includes a first ground terminal, a second ground terminal, and a latch member located between the first ground terminal and the second ground terminal. The latch member is provided with at least one elastic arm which protrudes out of the rear end of the insulating body. The front section of the elastic arm is in contact with the first ground terminal and the second ground terminal. The rear section of the elastic arm is located in the second metal shell and provided with a conducting portion which is projected toward the second metal shell. The conducting portion elastically urges against the second metal shell. The ground wire is in electrical contact with at least one of the first ground terminal, the second ground terminal, the latch member and the second metal shell.

In certain embodiments, an insertion cavity for the insertion of the receptacle connector is recessed backward from the front end of the insulating body. A first terminal group and a second terminal group are arranged respectively on the upper and lower sides of the insertion cavity and arranged centrosymmetrically. Each of the first terminal group and the second terminal group is provided with a plurality of signal terminals. The first terminal group has the first ground terminal and at least one first power terminal. The second terminal group has the second ground terminal and at least one second power terminal. The front end of the latch member is provided with a pair of latch arms which extend into the insertion cavity in order to latch the receptacle connector. An elastic arm is formed by bending outward from each latch arm and extending backward.

In certain embodiments, the first terminal group and an upper insulating block are insert-molded as a whole, and the second terminal group and a lower insulating block are insert-molded as a whole. The rear end of the insulating body is provided with a forward accommodating cavity. The upper insulating block and the lower insulating block are assembled into the accommodating cavity after being assembled together, and a placement platform protruding out of the rear end of the accommodating cavity is formed. The cable is arranged on the upper surface and lower surface of the placement platform in order to be soldered to the first terminal group and the second terminal group. The elastic arms protrude out of the rear end of the placement platform in order to elastically urge against the second metal shell.

In certain embodiments, the signal terminals include a first high-speed signal terminal and a second high-speed signal terminal which are arranged adjacently. The first high-speed signal terminal has a third contacting portion, a bending portion and a third soldering portion sequentially from the front to the rear. The extending direction of the bending portion is different from that of the third contacting portion. The bending portion and the third soldering portion are located on the same plane. The second high-speed signal terminal has a fourth contacting portion, a deflecting portion, a reverse bending portion and a fourth soldering portion sequentially from the front to the rear. The deflecting portion is formed by extending toward a bending direction close to the bending portion. The reverse bending portion is formed by bending reversely from the deflecting portion and located on the same plane as the deflecting portion. Both the third soldering portion and the fourth soldering portion are configured to be soldered to the signal wires.

In certain embodiments, the sidewall of the second metal shell is provided with a soldering hole, and the ground wire is inserted in the soldering hole in order to be soldered to the second metal shell.

In certain embodiments, the front end of the second metal shell is provided with a first covering portion for wrapping and fixing the rear side of the first metal shell, and the second metal shell is provided with a second covering portion for covering the cable. The cable-clamping portion is formed by extending backward from the rear end of the second covering portion. A ground sheet extending integrally from the second metal shell is located between the first covering portion and the second covering portion, wherein the ground assembly comprises a first ground terminal and a second ground terminal, and the ground sheet is in electrical contact with the first ground terminal or the second ground terminal.

Compared with the related art, certain embodiments of the present invention has the following beneficial advantages: the cable is in electrical contact with the first terminal group and the second terminal group, the latch member is provided with the backward elastic arms which protrude out of the insulating body, the second metal shell partially wraps the periphery of the first metal shell, and the elastic arms elastically urge against the second metal shell; since the elastic arms protrude out of the insulating body to elastically urge against the second metal shell, not only is the internal space of the electrical connector saved, but also the elastic arms can have enough elasticity to urge against the second metal shell, so that the latch member is in good contact with the second metal shell, and thereby the electrical connector has a stable grounding effect, guaranteeing the high-frequency transmission of the cable connector assembly.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the invention and together with the written description, serve to explain the principles of the invention. Wherever possible, the same reference numbers are used throughout the drawings to refer to the same or like elements of an embodiment.

DETAILED DESCRIPTION OF THE INVENTION

Figure 1:
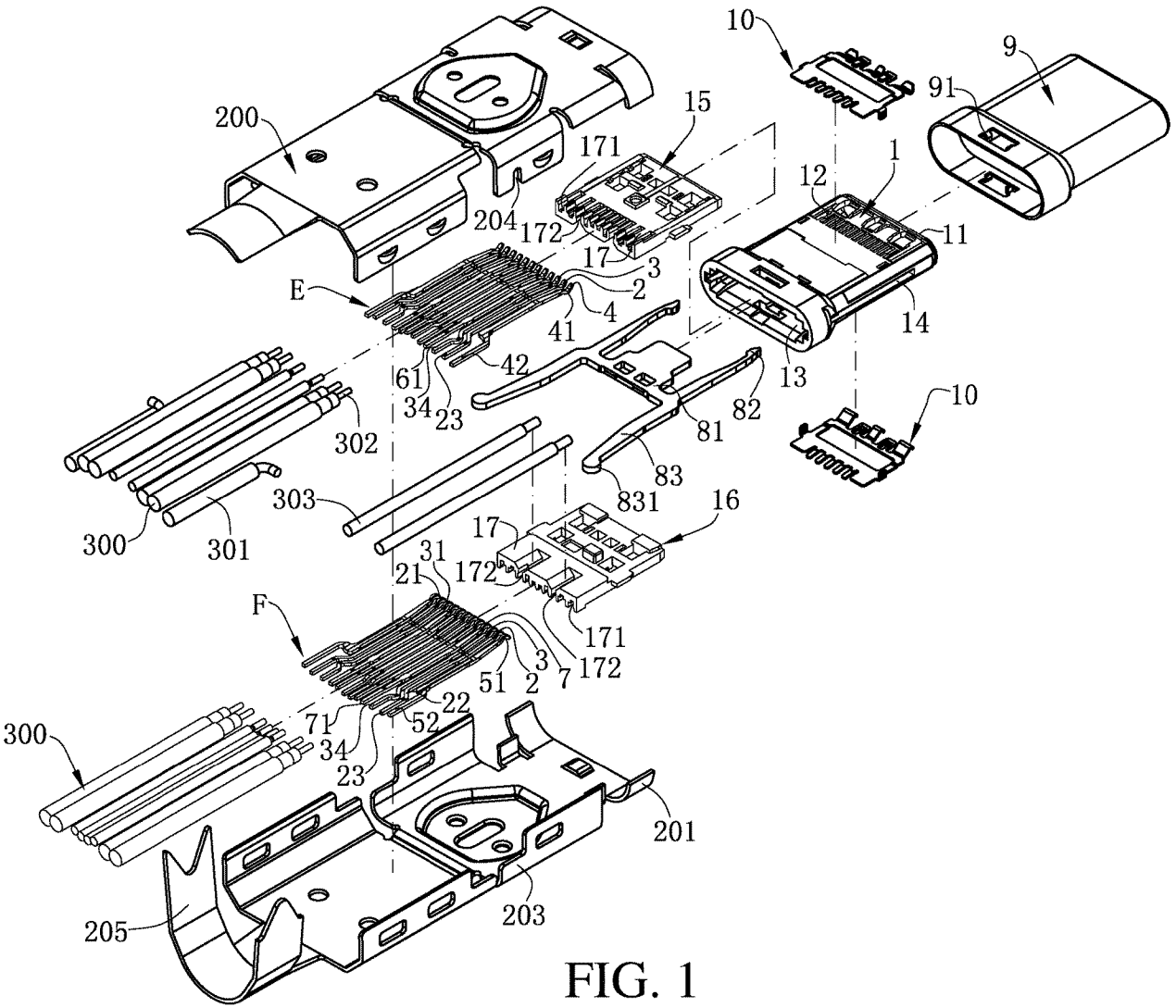
FIG. 1 is a schematic three-dimensional exploded view of a cable connector assembly according to one embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-8. In accordance with the purposes of this invention, as embodied and broadly described herein, this invention, in one aspect, relates to a cable connector assembly.

Figure 2:
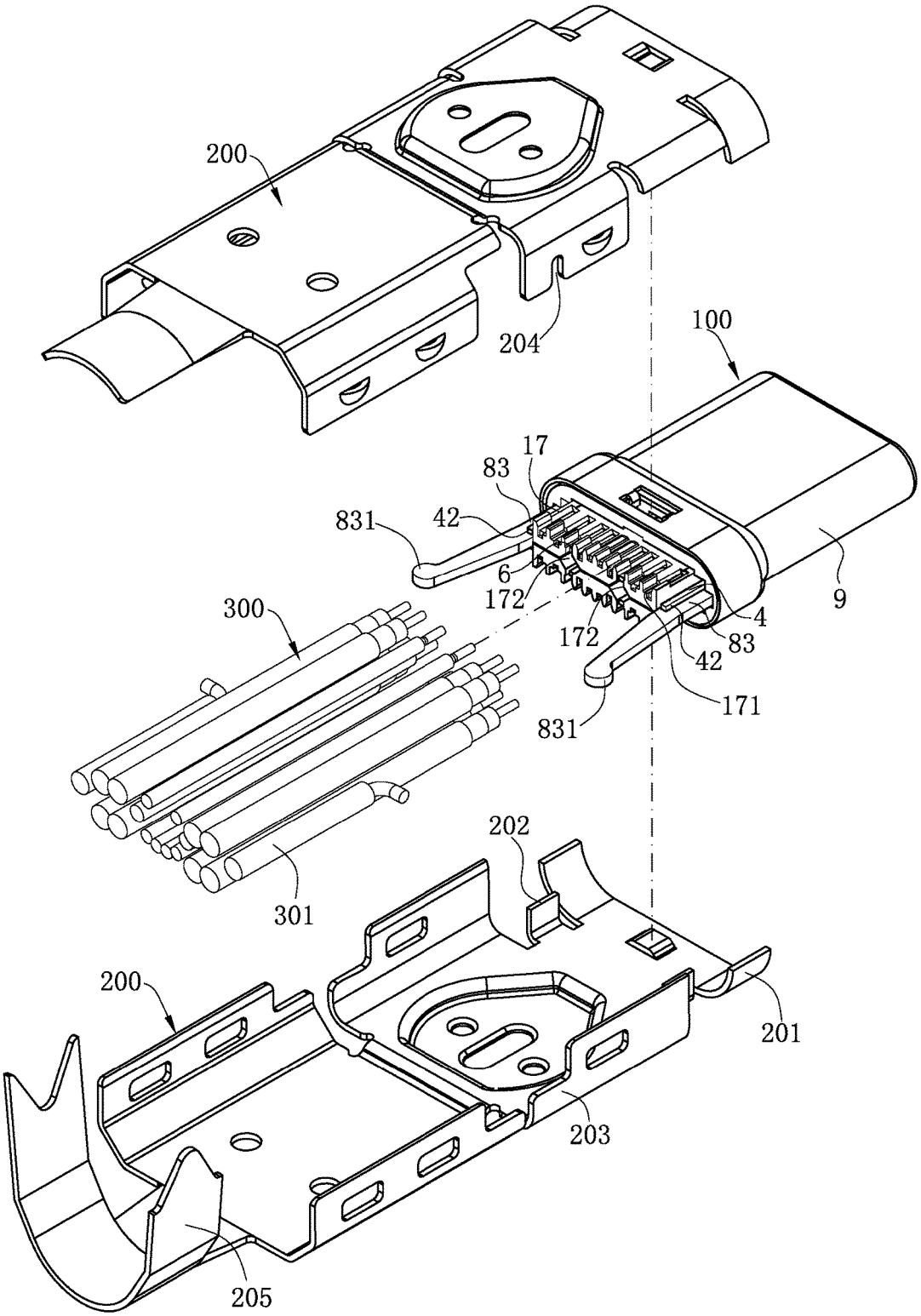
FIG. 2 is a local assembly view of a cable connector assembly according to one embodiment of the present invention.
Figure 3:
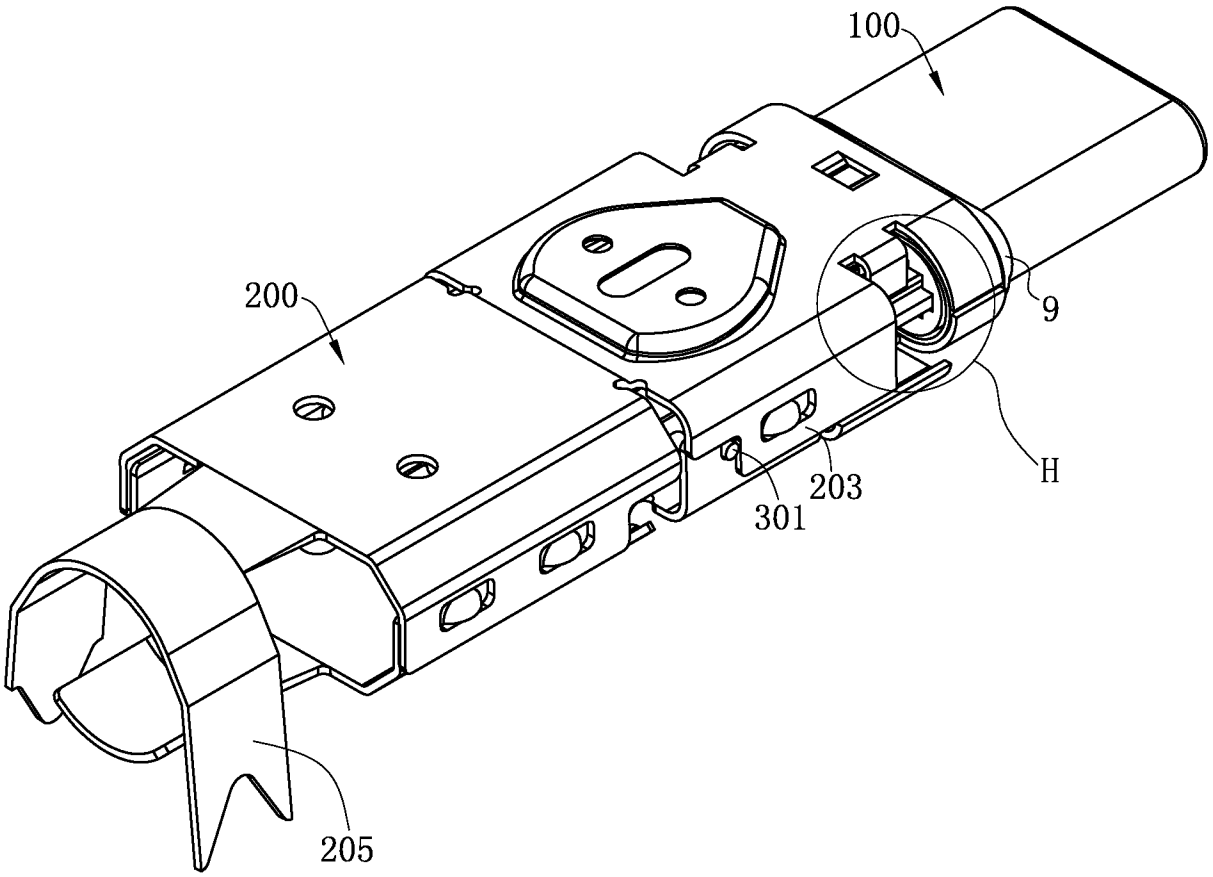
FIG. 3 is a schematic assembly view of a cable connector assembly according to one embodiment of the present invention.
Figure 4:
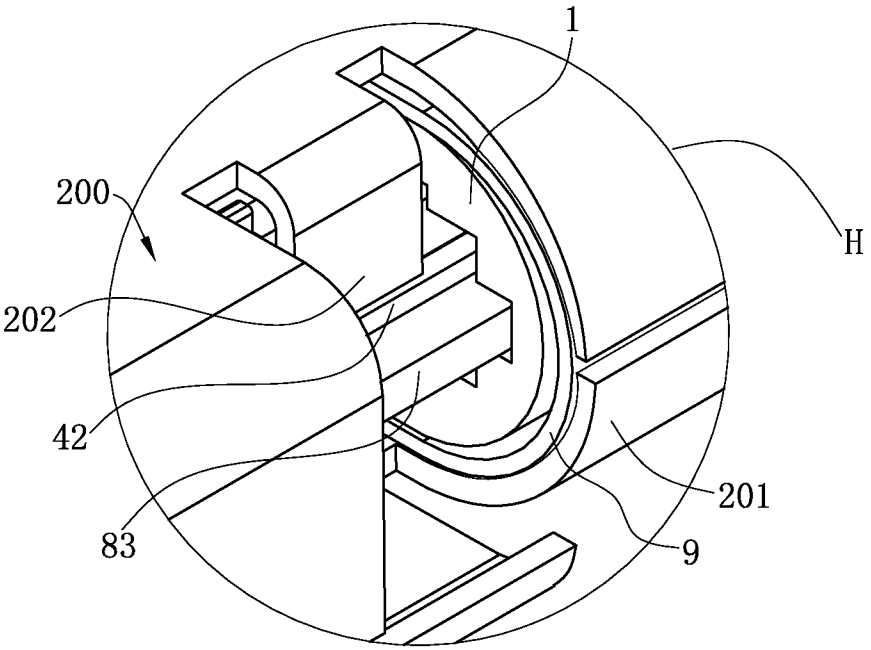
FIG. 4 is an enlarged view of part H in FIG. 3.

As shown in FIG. 1 and FIG. 2, a cable connector assembly of the present invention includes an electrical connector 100 and a cable 300 electrically connected to the electrical connector 100. The electrical connector 100 is an electrical connection plug which supports high-speed data transmission, and can be plugged in a receptacle connector (not shown). The electrical connector 100 includes an insulating body 1. The front end of the insulating body 1 is provided with an insertion cavity 11 for a tongue of the receptacle connector to be inserted therein. A plurality of signal terminals are received in the insulating body 1 and are in electrical contact with the receptacle connector. A ground assembly is retained in the insulating body 1 and partially protrudes out of the rear end of the insulating body 1. A first metal shell 9 sleeves the insulating body 1. One end of a second metal shell 200 wraps the periphery of the first metal shell 9, and the other end of the second metal shell 200 wraps and fixes the cable 300.

As shown in FIGS. 1, 2, 7 and 8, the ground assembly partially protrudes out of the insulating body 1 and is located outside of the first metal shell 9, and thereby the ground assembly partially enters into the second metal shell 200 to elastically urge against the second metal shell 200 to form electrical connection. In the present embodiment, the ground assembly includes a first ground terminal 4, a second ground terminal 5, and a latch member 8 located between the first ground terminal 4 and the second ground terminal 5. An elastic arm 83 extends backward from the latch member 8, and protrudes out of the rear end of the insulating body 1. The front section of the elastic arm 83 is in contact with the first ground terminal 4 and the second ground terminal 5, and the rear section of the elastic arm 83 elastically urges against the second metal shell 200 to form electrical conduction. In another embodiment, the ground assembly includes the latch member 8 and the first ground terminal 4. The latch member 8 is not provided with the elastic arm 83. The latch member 8 is in electrical contact with the first ground terminal 4, the rear end of the first ground terminal 4 is urges against the second metal shell 200. That is, the latch member 8 is conducted electrically with the second metal shell 200 by being in contact with the first ground terminal 4.

Figure 5:
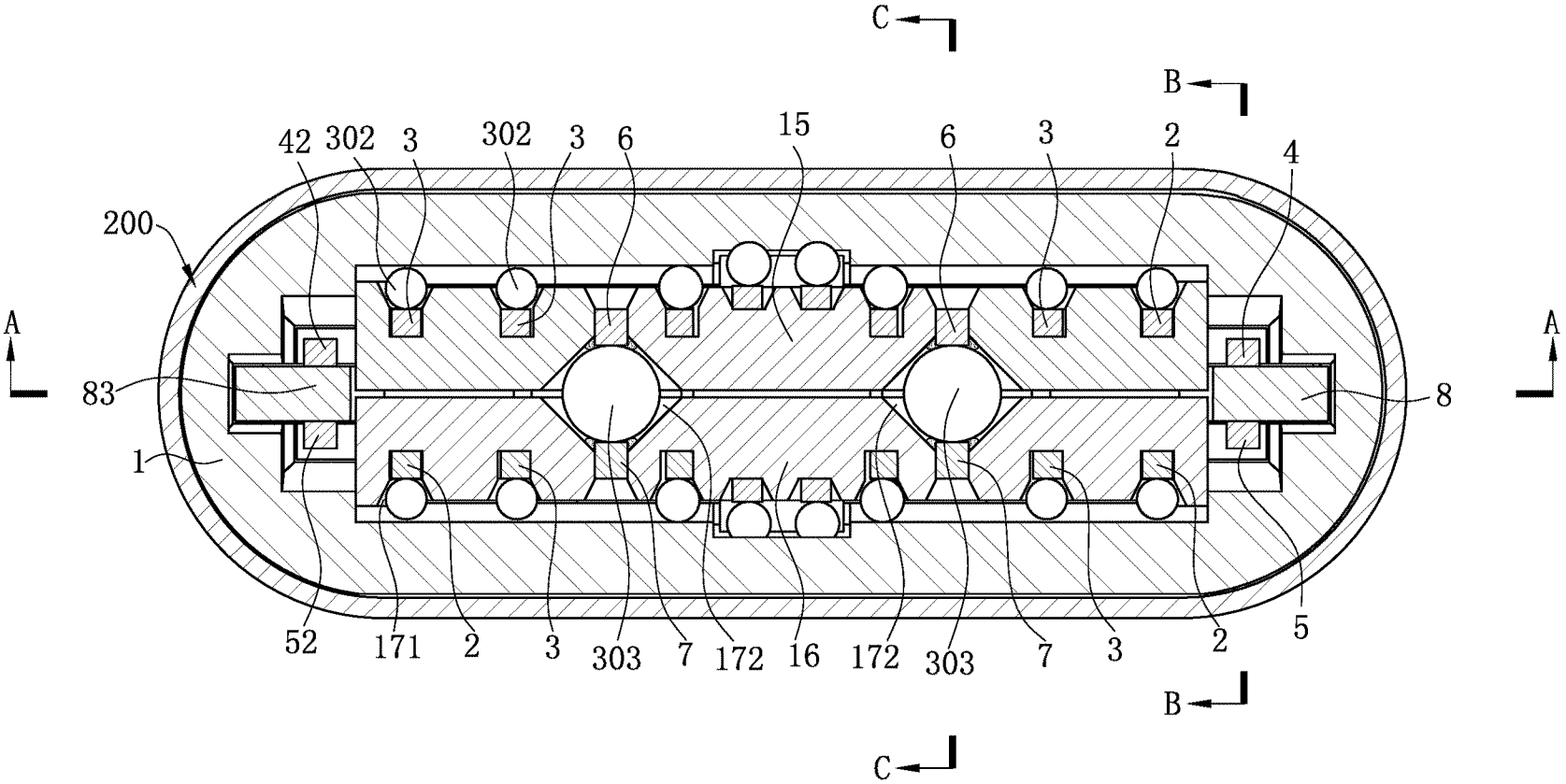
FIG. 5 is a sectional view of the cable connector assembly according to one embodiment of the present invention.

As shown in FIGS. 1, 2 and 5, the insertion cavity 11 for the insertion of the tongue of the receptacle connector is formed by recessing backward from the front end of the insulating body 1. A first terminal group E and a second terminal group F are arranged respectively on the upper and lower sides of the insertion cavity 11 and arranged centrosymmetrically. Each of the first terminal group E and the second terminal group F includes the signal terminals. The first terminal group E further includes at least one first ground terminal 4 and at least one first power terminal 6, and the second terminal group F further includes at least one second ground terminal 5 and at least one second power terminal 7. The first terminal group E and the second terminal group F are arranged in mutual point symmetry with the central point of the insertion cavity 11 as a symmetric center. That is, the first terminal group E and the second terminal group F have the same number of terminals and the arrangement sequence of the terminals is distribution in diagonal symmetry, so that the electrical connector 100 can be plugged in dual orientation in the receptacle connector. Both the first terminal group E and the second terminal group F are soldered to the cable 300 to form electrical contact. The first terminal group E and the second terminal group F each have twelve terminals, and are the same in arrangement sequence, which is: a ground terminal (GND), a first high-speed signal terminal 2 (SSTXp1), a second high-speed signal terminal 3 (SSTXn1), a power terminal (Vbus), a detecting terminal (CC), a universal serial bus (USB) 2.0 terminal pair (D+, D−), a reserved terminal (Vconn), a power terminal (Vbus), a second high-speed signal terminal 3 (SSTXn1), a first high-speed signal terminal 2 (SSTXp1), and a ground terminal (GND). The cable 300 has ground wires 301, power wires 303 and signal wires 302, corresponding to the first terminal group E and the second terminal group F. In the present embodiment, the electrical connector 100 is a USB TYPE C connector, and in the other embodiments, the electrical connector 100 also can be other specifications of connectors of the input/output (IO) class. The number of each of the first ground terminal 4, the second ground terminal 5, the first power terminal 6 and the second power terminal 7 is two in the present embodiment and can be one or more in the other embodiments as long as the number corresponds to the number of the ground wire 301 and power wire 303 of the cable 300.

Figure 6:
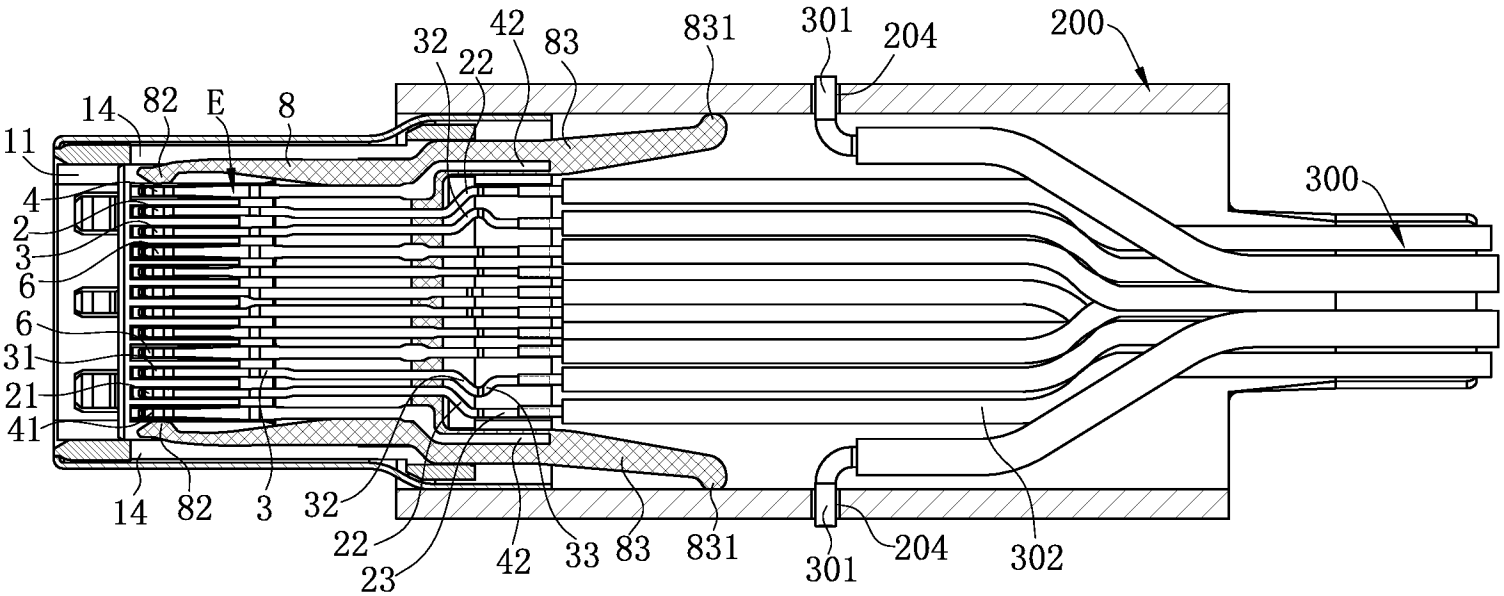
FIG. 6 is a sectional view of FIG. 5 along the A-A direction.

As shown in FIGS. 1, 2 and 6, the upper and lower surfaces of the insulating body 1 are provided respectively with a plurality of terminal slots 12 in communication with the insertion cavity 11. The terminal slots 12 are arranged in an upper row and a lower row on the insulating body 1. Both sidewalls of the insulating body 1 are provided respectively with a concave hollowed portion 14 in communication with the insertion cavity 11. A pair of shielding sheets 10 are installed respectively on the upper and lower surfaces of the insulating body 1, and are located at the front sides of the terminal slots 12. The rear end of the insulating body 1 is provided with a forward accommodating cavity 13, and the accommodating cavity 13 communicates with the terminal slots 12.

As shown in FIGS. 1, 2 and 5, an upper terminal module and a lower terminal module are also arranged in the insulating body 1. The upper terminal module includes an upper insulating block 15 and the first terminal group E integrally fixed in the upper insulating block 15 by insert-molding. The lower terminal module includes a lower insulating block 16 and the second terminal group F integrally fixed in the lower insulating block 16 by insert-molding. The lower insulating block 16 is provided with a fixing post for being received and fixed in a fixing hole disposed in the upper insulating block 15. The upper insulating block 15 and the lower insulating block 16 are assembled into the insulating body 1 from the rear to the front after being assembled together. The front ends of both the first terminal group E and the second terminal group F correspondingly enter into the terminal slots 12 and partially extend into the insertion cavity 11 to electrically connect with the receptacle connector. The front ends of the upper insulating block 15 and the lower insulating block 16 are fixed in the accommodating cavity 13. The rear ends of the upper insulating block 15 and the lower insulating block 16 jointly form a placement platform 17. The upper surface of the upper insulating block 15 is the upper surface of the placement platform 17, and the lower surface of the lower insulating block 16 is the lower surface of the placement platform 17. The placement platform 17 protrudes out of the accommodating cavity 13, the first terminal group E and the second terminal group F extend to the placement platform 17, and the placement platform 17 is configured for the placement of the cable 300, so that the cable 300 can be soldered conveniently to the first terminal group E and the second terminal group F. The upper surface and lower surface of the placement platform 17 are each provided with a plurality of concave wire arrangement slots 171 along the vertical direction. The cable 300 is provided with a plurality of conducting wires which are divided into two rows, and the two rows of conducting wires are received respectively in the wire arrangement slots 171 of the upper surface and lower surface of the placement platform 17 in order to be soldered to the first terminal group E and the second terminal group F. Along a direction from the rear end of the placement platform 17 to a front end of the placement platform 17, the rear end of the placement platform 17 is provided with at least one open slot 172 which communicates with the corresponding wire arrangement slot 171, and the open slot 172 is arranged for the placement of one of the conducting wires of the cable 300. In the present embodiment, the placement platform 17 is provided with two open slots 172, the two open slots 172 are arranged separately, and respectively run through the upper insulating block 15 and the lower insulating block 16 along the vertical direction. In the other embodiments, the placement platform 17 also can be provided with only one open slot 172 for the placement of a conducting wire.

As shown in FIGS. 2, 5, 6 and 9, the signal terminals are soldered correspondingly to the signal wires. The signal terminals include a first high-speed signal terminal 2 and a second high-speed signal terminal 3, which are arranged adjacently, and a plurality of low-speed signal terminals. The first high-speed signal terminal 2 has a first contacting portion 21, a first bending portion 22 and a first soldering portion 23 sequentially from the front to the rear. The first contacting portion 21 is received in the terminal slot 12 and extends into the insertion cavity 11. The first bending portion 22 is fixed in the upper insulating block 15. The first soldering portion 23 is located correspondingly in the wire arrangement slot 171 of the placement platform 17 in order to be soldered to the signal wire 302. The extending direction of the first bending portion 22 is different from that of the first contacting portion 21, and the first bending portion 22 is formed by bending horizontally by an angle from the first contacting portion 21. Both the first bending portion 22 and the first soldering portion 23 are located on the same plane, and the first soldering portion 23 is parallel to the first contacting portion 21. The second high-speed signal terminal 3 has a second contacting portion 31, a second bending portion 32, a reverse bending portion 33 and a second soldering portion 34 sequentially from the front to the rear. The second contacting portion 31 is received in the terminal slot 12 and extends into the insertion cavity 11. The second bending portion 32 and the reverse bending portion 33 are located on the same plane and both fixed in the upper insulating block 15. The second soldering portion 34 and the first soldering portion 23 are located side by side in the wire arrangement slots 171 of the upper surface of the placement platform 17 in order to be soldered to the signal wires 302. The second bending portion 32 is formed by extending toward a bending direction close to the first bending portion 22. That is, the bending directions of the second bending portion 32 and the first bending portion 22 are the same. The reverse bending portion 33 is formed by bending reversely from the second bending portion 32. Since the reverse bending portion 33 is formed by bending reversely from the second bending portion 32, the spacing between the first soldering portion 23 and the second soldering portion 34 is enlarged, and the space for accommodating the cable 300 is enlarged. Consequently, the soldering of the signal wires 302 is facilitated. Moreover, the production cost of the electrical connector 100 is reduced, and the manufacturing process is simplified. In addition, the arrangement of the reverse bending portion 33 enables the adjustment of the length of the second high-speed signal terminal 3, so that the lengths of the second high-speed signal terminal 3 and the first high-speed signal terminal 2 can be kept equal. Consequently, the effect of signal delay can be reduced, and the high-frequency effect of the electrical connector 100 can be guaranteed.

Figure 7:
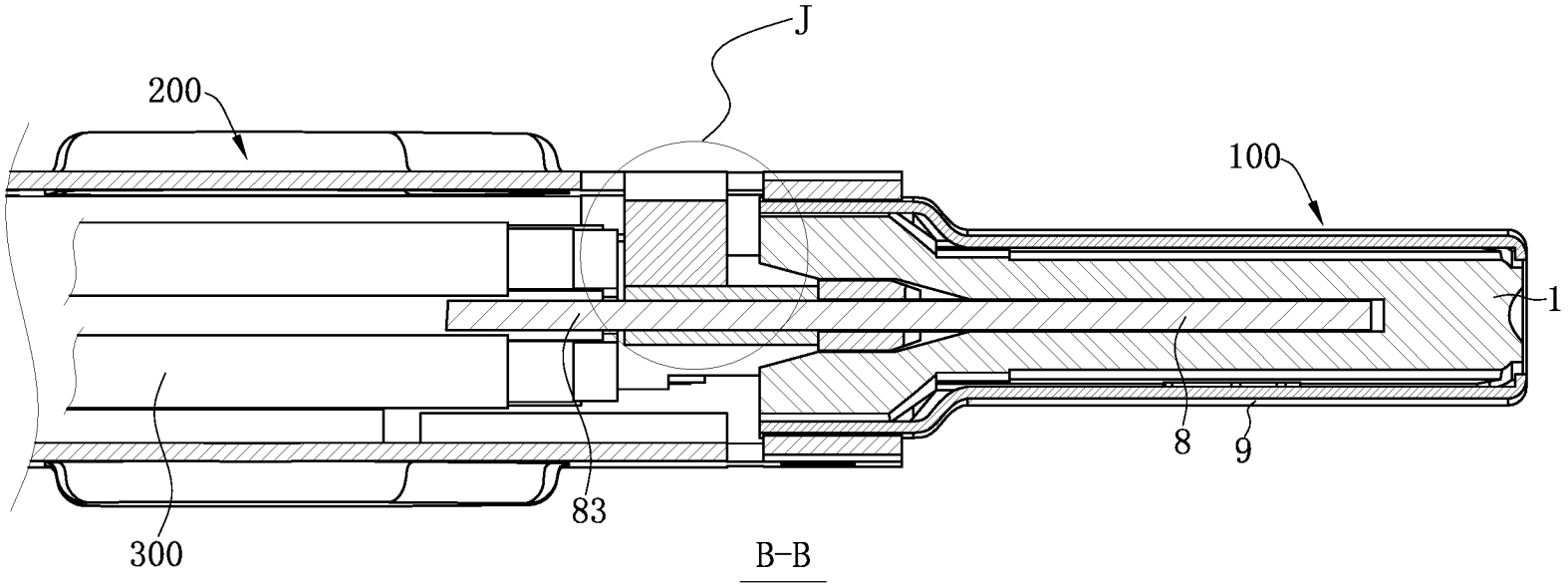
FIG. 7 is a sectional view of FIG. 5 along the B-B direction.
Figure 8:
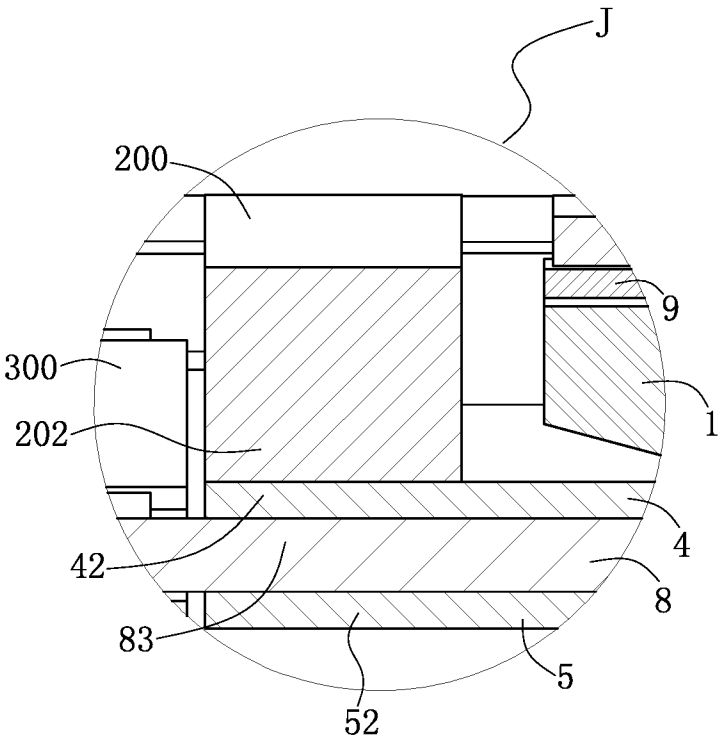
FIG. 8 is an enlarged view of part J in FIG. 7.

As shown in FIGS. 2, 5 and 7, the first terminal group E is provided with two first ground terminals 4 which are outermost, and the second terminal group F is provided with two second ground terminals 5 which are outermost and are aligned with the two first ground terminals 4 in one-to-one correspondence in the vertical direction. The front end of each first ground terminal 4 is provided with a third contacting portion 41, a third soldering portion 42 extends backward from the third contacting portion 41, and the third soldering portion 42 is located outside of the placement platform 17 in order to be in electrical contact with the upper surface of the latch member 8. The front end of each second ground terminal 5 is provided with a fourth contacting portion 51, a fourth soldering portion 52 extends backward from the fourth contacting portion 51, and the fourth soldering portion 52 is located outside of the placement platform 17 and is in electrical contact with the latch member 8 at the lower surface of the latch member 8. Therefore, both the third soldering portions 42 and the fourth soldering portions 52 do not occupy the space of the placement platform 17, and thereby the space of the placement platform 17 is saved, so that more signal wires can be contained in the placement platform 17 in order to be soldered conveniently to the signal terminals.

As shown in FIGS. 2, 5 and 6, the first terminal group E is provided with two first power terminals 6 which are correspondingly soldered to the two power wires 303, and the second terminal group F is provided with two second power terminals 7 which are correspondingly soldered to the two power wires 303. The front ends of the first power terminals 6 are received in the terminal slots 12 and extend into the upper side of the insertion cavity 11 in order to mate with the receptacle connector, and the rear end of each first power terminal 6 is provided with a first soldering surface 61 exposed to the upper side of the open slot 172. The front ends of the second power terminals 7 are received in the terminal slots 12 and extend into the lower side of the insertion cavity 11 in order to mate with the receptacle connector, each second power terminal 7 is provided with a second soldering surface 71 that is arranged opposite to the first soldering surface 61, and the second soldering surface 71 is exposed to the open slot 172. The power wires 303 are inserted in the open slots 172, and are located between the first soldering surfaces 61 and the second soldering surfaces 71, and the power wires 303 are soldered to the first soldering surfaces 61 and the second soldering surfaces 71 by utilizing solder, so that the first soldering surfaces 61 and the second soldering surfaces 71 are soldered firmly to the power wires 303. Since the power wires 303 are soldered between the first soldering surfaces 61 and the second soldering surfaces 71, the first power terminal 6 and the second power terminal 7 which have the same function can share one power wire 303. Consequently, not only is the number of the power wires 303 reduced, but also no connecting parts are added to connect the first power terminals 6 and the second power terminals 7, and thereby the manufacturing cost of the cable connector assembly is reduced effectively. Moreover, since the first power terminals 6 and the second power terminals 7 are soldered directly to the power wires 303, the problem of poor contact which is caused when the first power terminals 6 and the second power terminals 7 are first in contact with each other and are then soldered to the cable 300 is prevented, and thereby the first power terminals 6 and the second power terminals 7 can have a stable electrical connection effect with the cable 300.

As shown in FIGS. 1, 2 and 5, the latch member 8 is arranged in the insulating body 1 and located between the first terminal group E and the second terminal group F. The latch member 8 is inserted into the insulating body 1 from the rear to the front, and in the vertical direction, the latch member 8 is clamped between the upper terminal module and the lower terminal module. The latch member 8 has a base 81 which is fixed between the upper insulating block 15 and the lower insulating block 16. A pair of latch arms 82 respectively extend forward from both sides of the base 81, are contained in the hollowed portions 14 and extend into the insertion cavity 11 in order to latch the receptacle connector. At least one elastic arm 83 is deflected outward from the rear end of the latch member 8 and extends backward. The elastic arm 83 protrudes out of the accommodating cavity, and the end of the elastic arm 83 goes beyond the rear end surface of the placement platform 17, so the elastic arm 83 has enough elasticity. The front section of the elastic arm 83 is in contact with the third soldering portions 42 and the fourth soldering portions 52 of the upper and lower sides to form electrical conduction, and thereby the ground assembly is formed. The rear section of the elastic arm 83 protrudes out of the first metal shell 9 and enters into the second metal shell 200. The rear section of the elastic arm 83 is located in the second metal shell 200 and provided with a conducting portion 831 which is projected toward the second metal shell 200. The conducting portion 831 elastically urges against the sidewall of the second metal shell 200, therefore electrical conduction is formed between the ground assembly and the second metal shell 200, and thereby the first ground terminals 4, the second ground terminals 5 and the latch member 8 are connected electrically to the second metal shell 200 to achieve a grounding effect. Since the elastic arm 83 protrudes out of the insulating body 1 to elastically urge against the second metal shell 200, not only is the internal space of the electrical connector 100 saved, but also the elastic arm 83 has enough elasticity to urge against the second metal shell 200, so that the latch member 8 is in good contact with the second metal shell 200, and thereby the electrical connector 100 can have a stable grounding effect, guaranteeing the high-frequency transmission of the cable connector assembly.

As shown in FIGS. 1, 2 and 5, in the present embodiment, the latch member 8 is formed integrally, and in the other embodiments, the latch member 8 can also be formed separately. In the present embodiment, the latch member 8 is provided with two elastic arms 83, each elastic arm 83 is formed by bending outward from each latch arm 82 and extending backward. That is, the two elastic arms 83 are formed by bending toward directions departing from each other, and the spacing between the two elastic arms 83 is larger than the spacing between the two latch arms 82, so that more conducting wires can be placed between the two elastic arms 83.

As shown in FIGS. 1, 2, 7 and 8, the first metal shell 9 is cylindrical. The first metal shell 9 sleeves the periphery of the insulating body 1 from the front to the rear, and the elastic arms 83 protrude out of the first metal shell 9. The top and bottom of the first metal shell 9 are each provided with a retaining sheet 91 retaining the insulating body 1, and the placement platform 17 protrudes out of the first metal shell 9. That is, both the wire arrangement slots 171 of the upper insulating block 15 and the wire arrangement slots 171 of the lower insulating block 16 protrude out of the first metal shell 9.

As shown in FIGS. 3, 4, 7 and 8, the front end of the second metal shell 200 is provided with a first covering portion 201 that is configured to wrap and fix the rear side of the first metal shell 9, so that the placement platform 17 is received in the second metal shell 200. That is, the wire arrangement slots 171 are located in the second metal shell 200, and the cable 300 is fixed in the wire arrangement slots 171 in the second metal shell 200. The elastic arms 83 are located in the second metal shell 200, the conducting portions 831 are projected toward the sidewall of the second metal shell 200 in order to elastically urge against the sidewall of the second metal shell 200 to achieve the grounding effect. In the present embodiment, the elastic arms 83 are located in the second metal shell 200 to elastically urge against the second metal shell 200. In the other embodiments, the elastic arms 83 can also be located outside of the second metal shell 200 to elastically urge against the outer wall of the second metal shell 200. The second metal shell 200 is provided with a second covering portion 203 that is configured to cover the cable 300, the cable-clamping portion 205 is formed by extending from the rear end of the second covering portion 203, and the cable-clamping portion 205 is configured to clamp and fix the cable 300. A ground sheet 202 which integrally extends from the second metal shell 200 is located between the first covering portion 201 and the second covering portion 203, and the ground sheet 202 is in electrical contact with the first ground terminals 4 or the second ground terminals 5. In the present embodiment, the top wall of the second metal shell 200 is torn downward and extends to form the ground sheet 202, and the ground sheet 202 elastically urges against the first ground terminals 4, so that the ground sheet 202 is in electrical contact with the second metal shell 200. Since the ground sheet 202 is added under the premise that the elastic arms 83 elastically urge against the second metal shell 200, the ground assembly and the second metal shell 200 form multi-point contact, and thereby the grounding effect of the ground assembly is further enhanced. The second metal shell 200 includes an upper shell (not labeled) and a lower shell (not labeled). Both sides of the upper shell are provided with a plurality of fastening portions (not labeled), both sides of the lower shell are provided with a plurality of fastening holes (not labeled) which correspondingly match with the fastening portions, so that the upper shell and the lower shell can be fixed together, and the elastic arms 83 elastically urge against the sidewall of the upper shell. One side of the upper shell is provided with a soldering hole 204, and the soldering hole 204 is located between two adjacent fastening portions. In the present embodiment, the second metal shell 200 is formed separately, and in the other embodiments, the second metal shell 200 can also be formed integrally.

Figure 9:
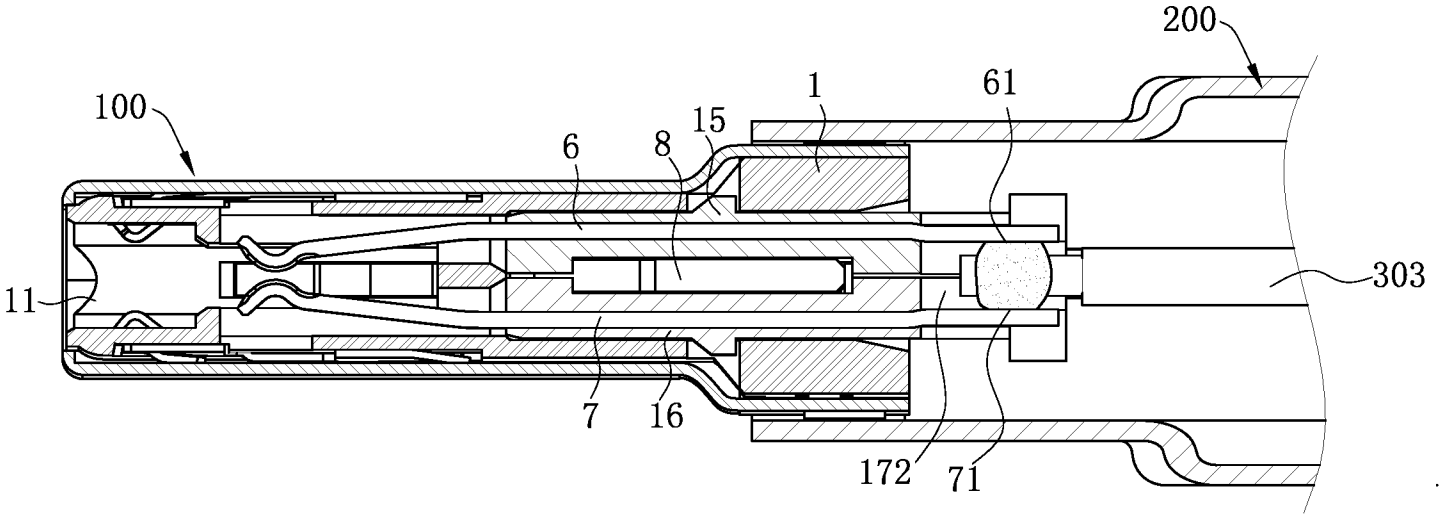
FIG. 9 is a sectional view of FIG. 5 along the C-C direction.

As shown in FIGS. 5, 6 and 9, during use, the front end of the electrical connector 100 is plugged in the receptacle connector, the rear end of the electrical connector 100 is in electrical contact with the cable 300, and thereby an electrical connection effect is achieved. The cable 300 includes the signal wires 302 which are located in the wire arrangement slots 171 of the placement platform 17 and soldered to the signal terminals. Both the first power terminals 6 and the second power terminals 7 are inserted in the open slots 172 and soldered to the power wires 303. The ground wires 301 are located outside of the placement platform 17 in order to be in electrical contact with at least one of the first ground terminals 4, the second ground terminals 5, the latch member 8 and the second metal shell 200. In the present embodiment, the ground wires 301 are inserted in the soldering holes 204 in order to be soldered to the second metal shell 200, and thereby the ground assembly, the second metal shell 200 and the ground wires 301 are connected electrically. The arranged soldering holes 204 are configured to better fix the ground wires 301, so that the ground wires 301 can be soldered firmly to the second metal shell 200. In the other embodiments, the ground wires 301 are in electrical contact with the ground assembly. That is, the ground wires 301 can be in electrical contact with any one or two or all of the first ground terminals 4, the second ground terminals 5 and the latch member 8, and the second metal shell 200 depends on contact with the ground assembly to be in electrical conduction with the ground wires 301 as long as it is ensured that the ground assembly is in electrical contact with the ground wires 301.

Figure 10:
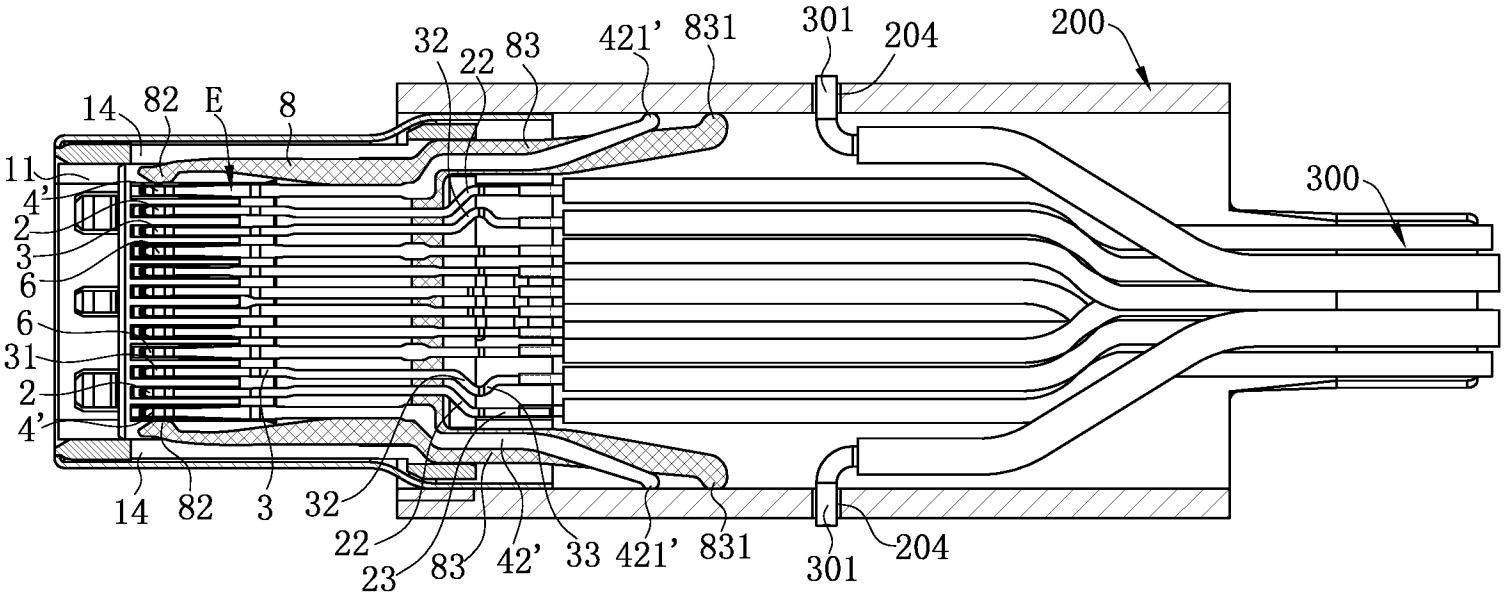
FIG. 10 is a sectional view of a cable connector assembly according to one embodiment of the second embodiment of the present invention.

FIG. 10 shows the second embodiment of the present invention, and the difference from the first embodiment is as follows: the ground assembly includes the first ground terminals 4', the second ground terminals, and the latch member 8 located between the first ground terminals 4' and the second ground terminals; the rear end of the third soldering portion 42' of each first ground terminals 4' is provided with a first elastic portion 421' which protrudes out of the rear end of the insulating body 1; the second ground terminal and the first ground terminal 4' have the same structure, that is, each second ground terminal is also provided with a second elastic portion that protrudes out of the rear end of the insulating body 1; the elastic arms 83 of the latch member 8 protrude out of the rear end of the insulating body 1 and are longer than the first elastic portions 421' and the second elastic portions, the ends of the elastic arms 83 elastically urge against the second metal shell 200, the first elastic portions 421' and the second elastic portions are located at the front sides of the elastic arms 83 to elastically urge against the second metal shell 200, consequently, the ground assembly and the second metal shell 200 form multi-point contact, good contact can be achieved as well, and thereby the electrical connector 100 can have a stable grounding effect, achieving the purpose of high-frequency transmission of the cable connector assembly.

In summary, the cable connector assembly according to certain embodiments of the present invention has the following beneficial advantages:

(1) The ground assembly elastically urges against the second metal shell 200 to form electrical conduction, and thereby the first ground terminals 4, the second ground terminals 5 and the latch member 8 are connected electrically to the second metal shell 200 to achieve a grounding effect. Since the elastic arms 83 protrude out of the insulating body 1 to elastically urge against the second metal shell 200, not only is the internal space of the electrical connector 100 saved, but also the elastic arms 83 have enough elasticity to urge against the second metal shell 200, so that the latch member 8 is in good contact with the second metal shell 200, and thereby the electrical connector 100 can have a stable grounding effect, guaranteeing the high-frequency transmission of the cable connector assembly.

(2) The ground wires 301 are inserted in the soldering holes 204 in order to be soldered to the second metal shell 200, and thereby the ground assembly, the second metal shell 200 and the ground wires 301 are connected electrically. The arranged soldering holes 204 are configured to better fix the ground wires 301, so that the ground wires 301 can be soldered firmly to the second metal shell 200.

(3) The ground sheet 202 elastically urges against the first ground terminals 4, so that the ground sheet 202 is in electrical contact with the second metal shell 200. Since the ground sheet 202 is added under the premise that the elastic arms 83 elastically urge against the second metal shell 200, the ground assembly and the second metal shell 200 form multi-point contact, and thereby the grounding effect of the ground assembly is further enhanced.

(4) Since the power wires 303 are soldered between the first soldering surfaces 61 and the second soldering surfaces 71, the first power terminal 6 and the second power terminal 7 which have the same function can share one power wire 303. Consequently, not only is the number of the power wires 303 reduced, but also no conducting parts are added to connect the first power terminals 6 and the second power terminals 7, and thereby the manufacturing cost of the cable connector assembly is reduced effectively. Moreover, since the first power terminals 6 and the second power terminals 7 are soldered directly to the power wires 303, the problem of poor contact which is caused when the first power terminals 6 and the second power terminals 7 are first in contact with each other and are then soldered to the cable 300 is prevented, and thereby the first power terminals 6 and the second power terminals 7 can have a stable electrical connection effect with the cable 300.

(5) Since the reverse bending portion 33 is formed by bending reversely from the second bending portion 32, the spacing between the first soldering portion 23 and the second soldering portion 34 is enlarged, and the space for accommodating the cable 300 is enlarged. Consequently, the soldering of the signal wires 302 is facilitated. Further, the production cost of the electrical connector 100 is reduced, and the manufacturing process is simplified. In addition, the arrangement of the reverse bending portion 33 enables the adjustment of the length of the second high-speed signal terminal 3, so that the lengths of the second high-speed signal terminal 3 and the first high-speed signal terminal 2 can be kept equal. Consequently, the affection of signal delay can be reduced, and the high-frequency effect of the electrical connector 100 can be guaranteed.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments are chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. A cable connector assembly for being plugged in a receptacle connector, comprising:

an electrical connector, comprising:

an insulating body;

a first terminal group and a second terminal group respectively received in the insulating body and arranged in an upper row and a lower row, wherein the first terminal group comprises at least one first ground terminal, and the second terminal group comprises at least one second ground terminal;

a latch member disposed in the insulating body and located between the first terminal group and the second terminal group, wherein the latch member comprises a pair of latch arms extending forward and received in the insulating body and at least one elastic arm extending backward and partially protruding out of the insulating body, the latch arms are configured to latch the receptacle connector, and both the at least one first ground terminal and the at least one second ground terminal are in electrical contact with the latch member; and a first metal shell wrapping a periphery of the insulating body, wherein the elastic arm protrudes backward out of the first metal shell;

a cable for electrical contacting with the first terminal group and the second terminal group; and a second metal shell, partially wrapping the periphery of the first metal shell and comprising a cable-clamping portion for fixing the cable, wherein the at least one elastic arm elastically urges against the second metal shell.

2. The cable connector assembly of claim 1, wherein the at least one elastic arm comprises two elastic arms, each of the two elastic arms is formed by deflecting outward from a rear end of corresponding one of the latch arms and extending backward, and a spacing between the two elastic arms is larger than a spacing between the two latch arms.

3. The cable connector assembly of claim 1, wherein the at least one first ground terminal and the at least one second ground terminal are located respectively on upper and lower sides of the at least one elastic arm to be in electrical contact with a front section of the at least one elastic arm, a rear section of the at least one elastic arm is provided with a conducting portion protruding toward a sidewall of the second metal shell, and the conducting portion elastically urges against the second metal shell.

4. The cable connector assembly of claim 1, wherein an elastic portion extends integrally from a rear end of the at least one first ground terminal or a rear end of the at least one second ground terminal, and protrudes out of a rear end of the insulating body, and the elastic portion is located at a front side of the at least one elastic arm to elastically urge against the second metal shell.

5. The cable connector assembly of claim 1, wherein the first terminal group and an upper insulating block are insert-molded as a whole, the second terminal group and a lower insulating block are insert-molded as a whole, a rear end of the insulating body is recessed forward with an accommodating cavity, the upper insulating block and the lower insulating block are installed into the accommodating cavity after being assembled together, a placement platform protruding out of a rear end of the accommodating cavity is formed, the cable is arranged on upper and lower surfaces of the placement platform in order to be soldered to the first terminal group and the second terminal group, and the at least one elastic arm protrudes out of a rear end of the placement platform for elastically urging against the second metal shell.

6. The cable connector assembly of claim 5, wherein the placement platform is provided with at least one open slot along a direction from the rear end of the placement platform to a front end of the placement platform, the first terminal group comprises at least one first power terminal, the first power terminal has a first soldering surface exposed to the open slot, the second terminal group comprises at least one second power terminal, the second power terminal has a second soldering surface exposed to the open slot, the cable comprises at least one power wire for being inserted into the open slot and located between the first soldering surface and the second soldering surface, such that the power wire is solderable to the first soldering surface and the second soldering surface.

7. The cable connector assembly of claim 1, wherein a front end of the second metal shell is provided with a first covering portion for wrapping and fixing a rear side of the first metal shell, the second metal shell is provided with a second covering portion for covering the cable, the cable-clamping portion is formed by extending backward from a rear end of the second covering portion, a ground sheet extends integrally from the second metal shell and is located between the first covering portion and the second covering portion, and the ground sheet is in electrical contact with the first ground terminal or the second ground terminal.

8. The cable connector assembly of claim 1, wherein the cable comprises at least one ground wire, and the at least one ground wire is in electrical contact with at least one of the at least one first ground terminal, the at least one second ground terminal, the latch member and the second metal shell.

9. The cable connector assembly of claim 8, wherein a sidewall of the second metal shell is provided with a soldering hole, and the ground wire is inserted in the soldering hole in order to be soldered to the second metal shell.

10. The cable connector assembly of claim 9, wherein the second metal shell comprises an upper shell and a lower shell, both sides of the upper shell are provided with a plurality of fastening portions, both sides of the lower shell are provided with a plurality of fastening holes respectively matching with the plurality of fastening portions, and the soldering hole is located between two neighboring fastening portions.

11. A cable connector assembly for electrically connecting with a receptacle connector, comprising:

an electrical connector, comprising:

an insulating body;

a plurality of signal terminals received in the insulating body for electrically contacting with the receptacle connector;

a ground assembly, received in the insulating body and partially protruding out of a rear end of the insulating body; and a first metal shell wrapping a periphery of the insulating body;

a second metal shell, partially wrapping a periphery of the first metal shell and comprising a cable-clamping portion, wherein the ground assembly elastically urges against the second metal shell; and a cable fixed by the cable-clamping portion, wherein the cable comprises a plurality of signal wires and at least one ground wire, the signal wires respectively contact with the signal terminals, and the ground wire is in electrical contact with at least one of the ground assembly and the second metal shell.

12. The cable connector assembly of claim 11, wherein the ground assembly comprises a first ground terminal and a latch member, a front end of the latch member is provided with a pair of latch arms for latching the receptacle connector, an elastic arm extends backward from each of the latch arms and protrudes out of the rear end of the insulating body, the elastic arms elastically urge against the second metal shell, and the first ground terminal is in electrical contact with at least one of the latch member and the second metal shell.

13. The cable connector assembly of claim 11, wherein the ground assembly comprises a first ground terminal and a latch member, the latch member is in electrical contact with the first ground terminal, a rear end of the first ground terminal is provided with an elastic portion protruding out of the rear end of the insulating body, and the elastic portion elastically urges against the second metal shell.

14. The cable connector assembly of claim 11, wherein the ground assembly comprises a first ground terminal, a second ground terminal, and a latch member located between the first ground terminal and the second ground terminal, a rear end of the first ground terminal is provided with a first elastic portion protruding out of the rear end of the insulating body, a rear end of the second ground terminal is provided with a second elastic portion protruding out of the rear end of the insulating body, a front end of the latch member is provided with a pair of latch arms for latching the receptacle connector, at least one elastic arm extends backward from the latch member and protrudes out of the rear end of the insulating body, the elastic arm elastically urges against the second metal shell, and the first elastic portion and the second elastic portion are located at a front side of the elastic arm to elastically urge against the second metal shell.

15. The cable connector assembly of claim 11, wherein the ground assembly comprises a first ground terminal, a second ground terminal, and a latch member located between the first ground terminal and the second ground terminal, the latch member is provided with at least one elastic arm protruding out of a rear end of the insulating body, a front section of the at least one elastic arm is in contact with the first ground terminal and the second ground terminal, a rear section of the at least one elastic arm is located in the second metal shell and provided with a conducting portion projecting toward the second metal shell, the conducting portion elastically urges against the second metal shell, and the ground wire is in electrical contact with at least one of the first ground terminal, the second ground terminal, the latch member and the second metal shell.

16. The cable connector assembly of claim 15, wherein an insertion cavity for the receptacle connector to be inserted therein is recessed backward from a front end of the insulating body, a first terminal group and a second terminal group are arranged respectively on upper and lower sides of the insertion cavity and arranged centrosymmetrically, each of the first terminal group and the second terminal group comprises a plurality of signal terminals, the first terminal group further comprises the first ground terminal and at least one first power terminal, the second terminal group further comprises the second ground terminal and at least one second power terminal, a front end of the latch member is provided with a pair of latch arms extending into the insertion cavity in order to latch the receptacle connector, and an elastic arm is formed by bending outward from each of the latch arms and extending backward.

17. The cable connector assembly of claim 16, wherein the first terminal group and an upper insulating block are insert-molded as a whole, the second terminal group and a lower insulating block are insert-molded as a whole, the rear end of the insulating body is provided with an accommodating cavity recessing forward, the upper insulating block and the lower insulating block are installed into the accommodating cavity after being assembled together, a placement platform protruding out of a rear end of the accommodating cavity is formed, the cable is arranged on upper surface and lower surface of the placement platform in order to be soldered to the first terminal group and the second terminal group, and the elastic arms protrude out of the rear end of the placement platform in order to elastically urge against the second metal shell.

18. The cable connector assembly of claim 11, wherein the signal terminals include a first high-speed signal terminal and a second high-speed signal terminal which are arranged adjacently, the first high-speed signal terminal has a third contacting portion, a bending portion and a third soldering portion sequentially from front to rear, an extending direction of the bending portion is different from that of the third contacting portion, the bending portion and the third soldering portion are located on a same plane, the second high-speed signal terminal has a fourth contacting portion, a deflecting portion, a reverse bending portion and a fourth soldering portion sequentially from front to rear, the deflecting portion is formed by extending toward a bending direction toward to the bending portion, the reverse bending portion is formed by bending reversely from the deflecting portion and located on a same plane as the deflecting portion, and both the third soldering portion and the fourth soldering portion are configured to be soldered to the signal wires.

19. The cable connector assembly of claim 11, wherein a sidewall of the second metal shell is provided with a soldering hole, and the ground wire is inserted in the soldering hole in order to be soldered to the second metal shell.

20. The cable connector assembly of claim 11, wherein a front end of the second metal shell is provided with a first covering portion for wrapping and fixing a rear side of the first metal shell, the second metal shell is provided with a second covering portion for covering the cable, the cable-clamping portion is formed by extending backward from the rear end of the second covering portion, a ground sheet extending integrally from the second metal shell is located between the first covering portion and the second covering portion, wherein the ground assembly comprises a first ground terminal and a second ground terminal, and the ground sheet is in electrical contact with the first ground terminal or the second ground terminal.

* * * * *